United States Patent [19]

Murakami

[11] Patent Number: 5,061,204

[45] Date of Patent: Oct. 29, 1991

[54] CONNECTOR ENGAGEMENT DETECTING APPARATUS

[75] Inventor: Yoshihiro Murakami, Shizuoka, Japan

[73] Assignee: Yazaki Corporation, Tokyo, Japan

[21] Appl. No.: 672,290

[22] Filed: Mar. 20, 1991

[30] Foreign Application Priority Data

Mar. 23, 1990 [JP] Japan ..... 2-72061

[51] Int. Cl.[5] ..... H01R 3/00

[52] U.S. Cl. ..... 439/489; 439/490

[58] Field of Search ..... 439/188, 488, 489, 490, 439/491, 350, 357, 507, 509; 200/51.09, 51.1

[56] References Cited

U.S. PATENT DOCUMENTS

| | | | |
|---|---|---|---|
| 4,871,323 | 10/1989 | Ohsumi | 439/188 |
| 4,878,853 | 11/1989 | Yamade et al. | 439/490 X |
| 4,900,267 | 2/1990 | Nagasaka et al. | 439/489 |
| 4,915,649 | 4/1990 | Shimazu et al. | 439/490 |
| 4,950,179 | 8/1990 | Takenouchi et al. | 439/352 |

*Primary Examiner*—Larry I. Schwartz
*Assistant Examiner*—Khiem Nguyen
*Attorney, Agent, or Firm*—Armstrong, Nikaido, Marmelstein, Kubovcik & Murray

[57] ABSTRACT

A male connector housing has a resilient lock arm and a movable piece mounted slidably on the lock arm. The rear end of the resilient lock arm is provided with a short-circuit path. The movable piece has two separate connecting electric paths, each of which has its one end attached to the underside of a top plate portion of the movable piece and the other end extending to the bottom of leg portions of the movable piece. The bottom portions of the two separate connecting electric paths are in sliding contact with terminal lugs installed in adjacent terminal accommodating chambers. As the two mating connector housings begin to be engaged, an engagement frame formed at the front end of the female connector housing pushes the movable piece backward and at the same time a lock projection formed at the upper surface of the lock arm advances into the engagement frame, deflecting the resilient lock arm downwardly. When the two connector housings are connected completely, the lock projection is received into an engagement hole in the engagement frame and the lock arm snaps back to its original shape, causing the rear end of the lock arm to engage with the underside of the movable piece. This short-circuits the two connecting electric paths on the underside of the movable piece, completing a detection circuit.

3 Claims, 5 Drawing Sheets

CONNECTOR ENGAGEMENT DETECTING APPARATUS

BACKGROUND OF THE INVENTION

1. Field of the Invention

The present invention relates to a connector engagement detecting apparatus which has a means to determine whether or not a pair of mating connectors used for connection of automotive wiring harnesses are normally joined together.

2. Prior Art

Referring to FIGS. 6 and 7, one of mating connector housings a is formed with a contact accommodating chamber d in which a pair of electric contacts b, c are inserted in non-contacting condition. The other mating connector housing e has a drive piece f, formed as a resilient cantilever, whose free end $f_1$ forces the lower contact c upward into contact with the upper contact b. The connector housing a also has an interfering projection g in front of the electric contact c, which, when the paired connector housings fail to be connected normally, abuts against the free end $f_1$ of the drive piece f, deflecting it to block the electric contacts b, c from coming into forced contact with each other. When the mating connector housings are completely connected together, the interfering projection g is received into a recess $f_2$ allowing the drive piece f to move from a position indicated by a broken line in FIG. 7*b* to a position of a solid line, which in turn causes the contact c to engage with the contact b to complete a detection circuit.

In the above-mentioned prior art, since the dedicated chamber d for accommodating the detecting electric contacts b, c is necessary, the connector housing becomes complex in shape, making the resin molding process correspondingly more difficult. Moreover, the drive piece f made of resin material may undergo thermal deformation from ambient heat generated during service. In that case, the driving force acting on the electric contact c decreases, degrading the reliability of electric conduction through the electric contacts b and c.

SUMMARY OF THE INVENTION

The present invention has been accomplished to overcome the above drawbacks and its objective is to provide a connector engagement detecting apparatus which requires no dedicated chamber for accommodating the detection contacts, which can simplify the shape of the connector housing and which maintains a high reliability of electric conduction through the detecting contacts.

To achieve the above objective, a connector engagement detecting apparatus of this invention comprises: a first connector housing and a second connector housing, said first and second connector housing being adapted to be joined together; a resilient lock arm provided to the first connector housing; an engagement portion provided to the second connector housing to cooperate with said resilient lock arm; a movable piece for detecting the correct engagement of the two mating connector housings, said movable piece being mounted on the first connector housing so that it can be moved relative to the resilient lock arm; two connecting electric paths formed on said movable piece and having elastic contact ends; slots formed between a displacement permitting space for the resilient lock arm and adjacent terminal accommodating chambers, said slots being used to accommodate the contact ends of the two connecting electric paths so that the contact ends are in sliding contact with the terminal lugs contained in terminal accommodating chambers; and a short-circuit conducting path provided to a free end of the resilient lock arm, said short-circuit conducting path being adapted to engage with the two connecting electric paths when the male and female connector housings are connected completely.

PREFERRED EMBODIMENT OF THE INVENTION

Figure 1:
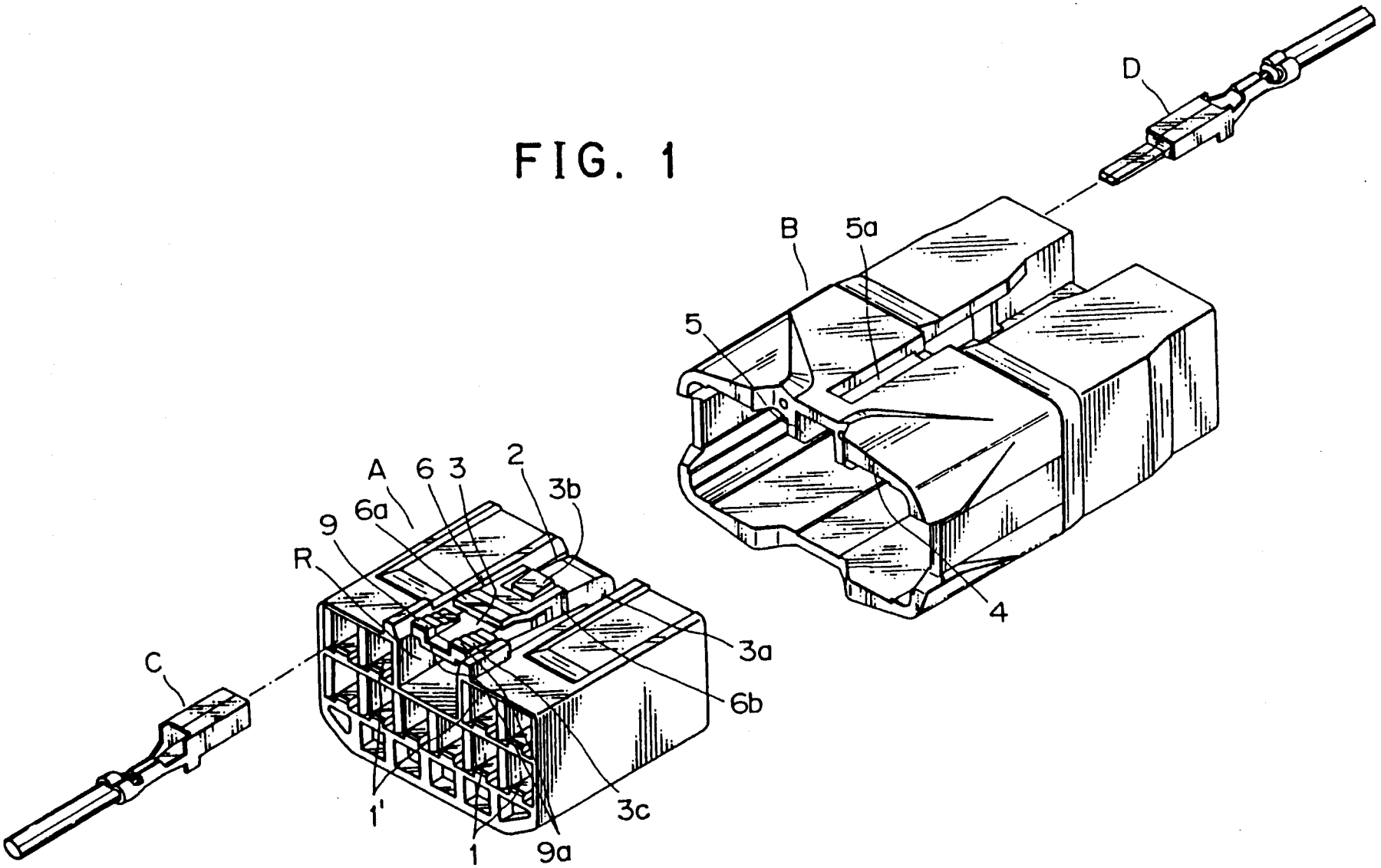
FIG. 1 is a perspective view of one embodiment of this invention with a pair of connector housings separated.
Figure 2:
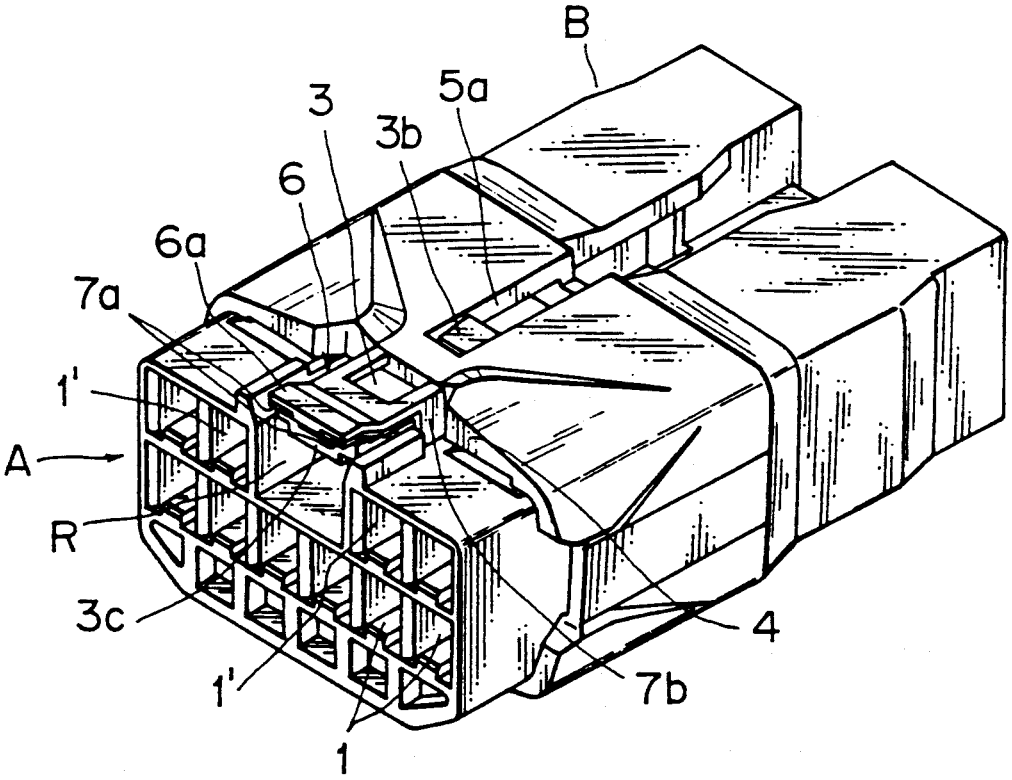
FIG. 2 is a perspective view of the embodiment with the pair of connector housings joined.
Figure 3:
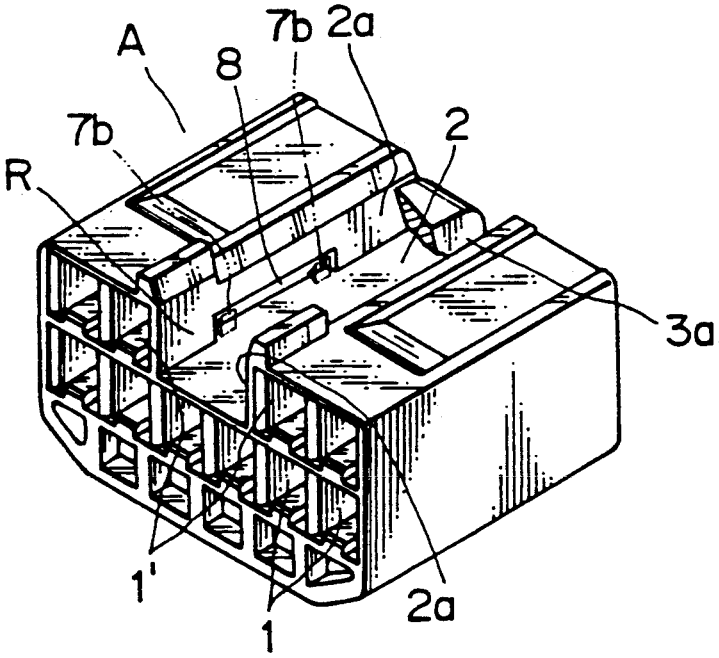
FIG. 3 is a perspective view of one of the paired connector housings shown partly cut away.
Figure 4:
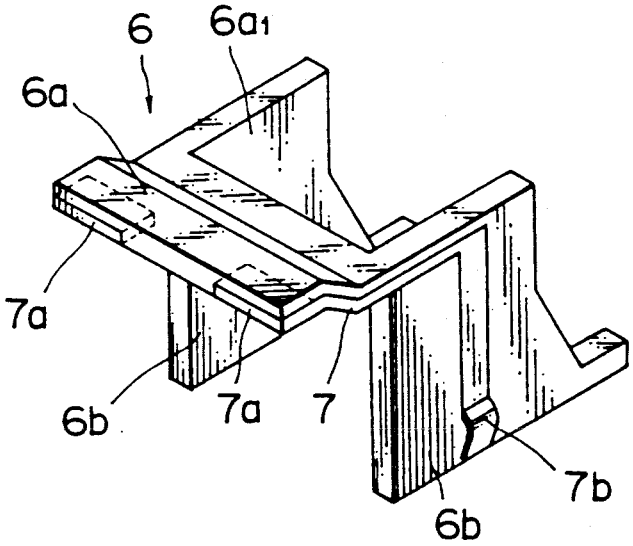
FIG. 4 is a perspective view of a movable piece for detecting the correct engagement of the connector housings.
Figure 6:
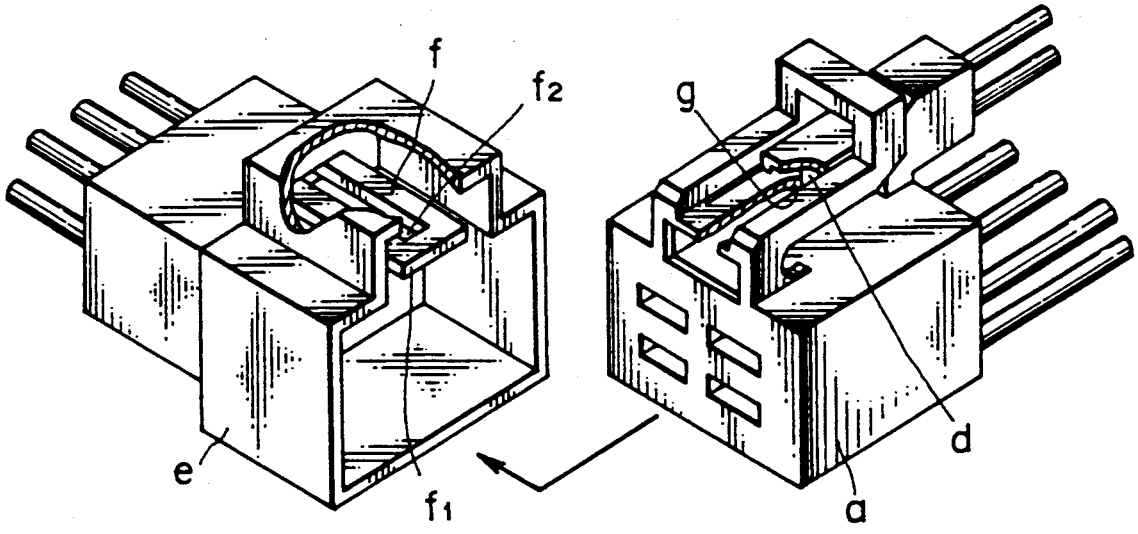
FIG. 6 PRIOR ART
FIG. 6 is a perspective view of a prior art connector shown partly cut away.

Referring to FIGS. 1 through 3, denoted A is a male connector housing, and B a female connector housing, both made of synthetic resin material.

The male connector housing A, as is known, is formed with a plurality of terminal accommodating chambers 1 in which female terminal lugs C are inserted and fixed. The female connector housing B also has a plurality of terminal accommodating chambers (not shown) in which male terminal lugs D are inserted and fixed.

In a recessed portion 2 on the upper surface of the male connector housing A is provided a rearwardly extending, resilient cantilever lock arm 3 which has a rising base portion 3*a* at the front end of the housing. The resilient lock arm 3 has a lock projection 3*b* formed on the upper surface of the middle portion thereof and an unlock pressing portion 3*c* at the free rear end thereof. The female connector housing B has formed at the center of the front end of an upper wall 4 an engagement frame 5 that engages with the resilient lock arm 3. The engagement frame 5 is formed with an engagement hole 5*a* to receive the lock projection 3*b*.

The connector engagement detecting apparatus with the above-mentioned construction acts as follows. When the male and female connector housings A, B are fitted together, the female and male terminal lugs C, D are brought into contact with each other. At the same time, as the lock projection 3*b* abuts on the engagement frame 5, the resilient lock arm 3 deflects downwardly into a displacement permitting space R formed immediately below and, when the lock projection 3*b* is received into the engagement hole 5*a*, returns to its original shape, thus locking the male and female connector housings in the complete engagement condition.

Designated 6 is a movable piece for detecting the correct engagement of the connector housings. The engagement detection movable piece 6 is made of synthetic resin and formed into a gate-like contour. The movable piece 6 has two independent connecting electric paths 7 formed of conductive materials which extend from a top plate portion 6*a*, which is recessed at $6a_1$, down to leg portions 6*b*. The connecting electric paths 7 are exposed as contact portions 7*a* a at the underside of the top plate portion 6*a* and also project as elastic contact ends 7*b* at the external lower ends of the leg portions 6*b*.

The engagement detection movable piece 6 straddles on the resilient lock arm 3 in such a manner that it can be moved longitudinally of the male connector housing A over a distance from the lock projection 3*b* to the unlock press portion 3*c*. The leg portions 6*b* of the movable piece 6 are in sliding contact with side walls 2*a* that form the recessed portion 2. At the bottom of the side walls 2*a*, the elastic contact ends 7*b* on the movable piece 6 project into slots 8 formed between the recessed portion 2 and the adjacent terminal accommodating chambers 1' and come into contact with the terminal lugs C installed in the terminal accommodating chambers 1'. As the engagement detection movable piece 6 moves, the elastic contact ends 7*b* also move while in sliding contact with the terminal lugs C.

On the upper surface of the unlock press portion 3*c* at the free end of the resilient lock arm 3 is provided a short-circuit conducting path 9, which has contacts 9*a* that correspond to the contact portions 7*a* of the connecting electric paths 7.

Figure 5A:
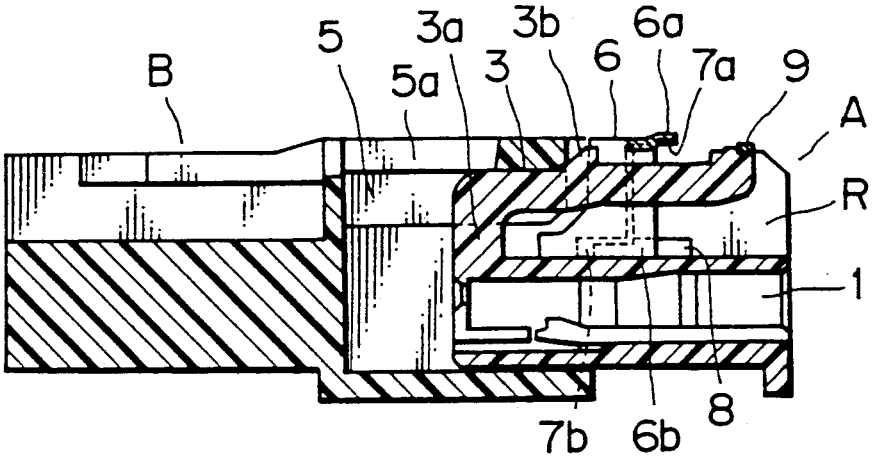
FIGS. 5*a*, 5*b* and 5*c* are cross sections of the paired connector housings, with FIG. 5*a* showing an initial stage of the joining process, FIG. 5*b* showing the connector housings joined in an imperfect condition, and FIG. 5*c* showing them in a completely joined condition.

In the above construction, during the initial stage of connecting the male and female connector housings A, B, the top plate portion 6*a* of the engagement detection movable piece 6 is situated between the lock projection 3*b* and the unlock press portion 3*c* of the resilient lock arm 3. As the connecting process proceeds, the top plate portion 6*a* is pushed rearwardly by the engagement frame 5 of the female connector housing B, as shown in FIG. 5*a*.

Figure 5B:
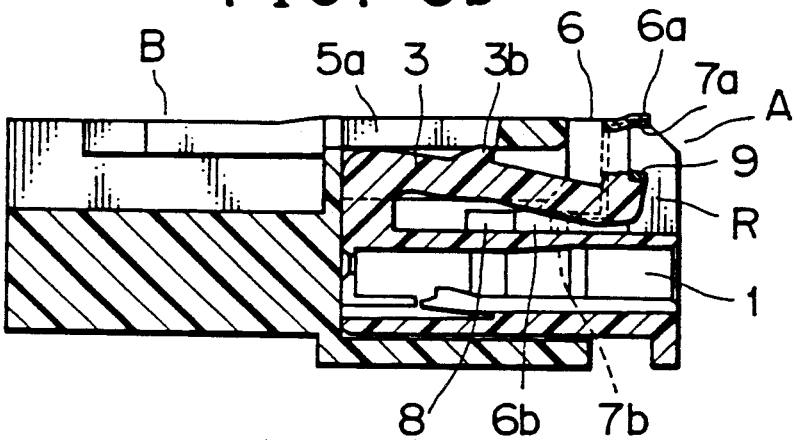

Next, as shown in FIG. 5*b*, the lock projection 3*b* advances into the engagement frame 5 deflecting downwardly the free end of the resilient lock arm 3, i.e. the unlock press portion 3*c*. In this imperfect engagement condition, the short-circuit conducting path 9 is separated from the connecting electric paths 7 on the movable piece 6.

Figure 5C:
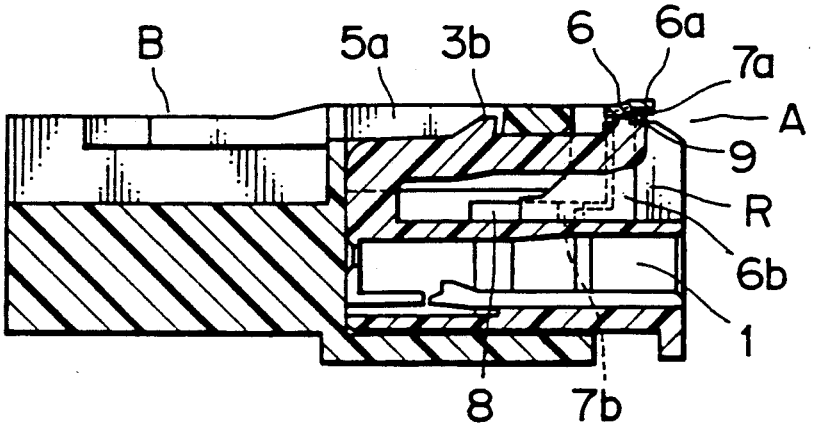
Figure 7A:
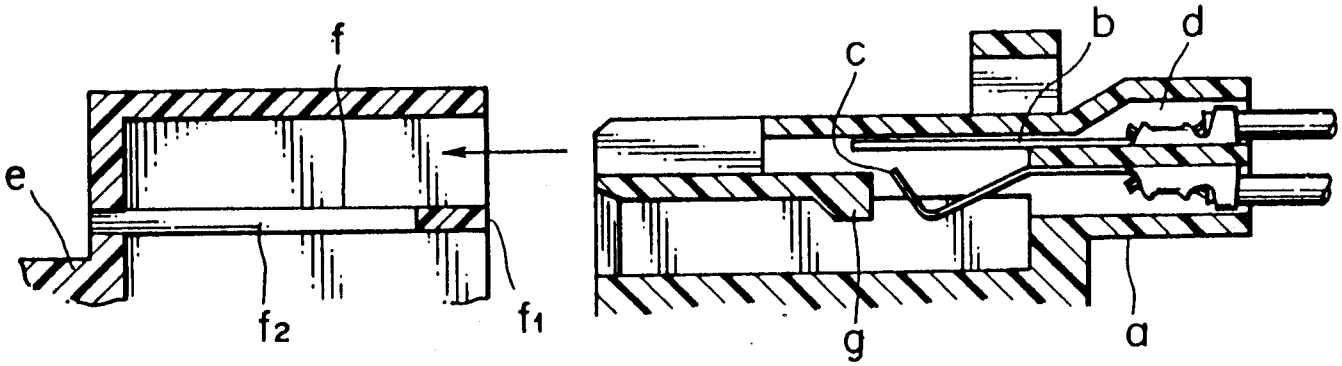
FIG. 7a PRIOR ART
FIGS. 7*a* and 7*b* are cross sections of essential portion of FIG. 6, with FIG. 7*a* showing the connector housings separated and FIG. 7*b* showing them connected.
Figure 7B:
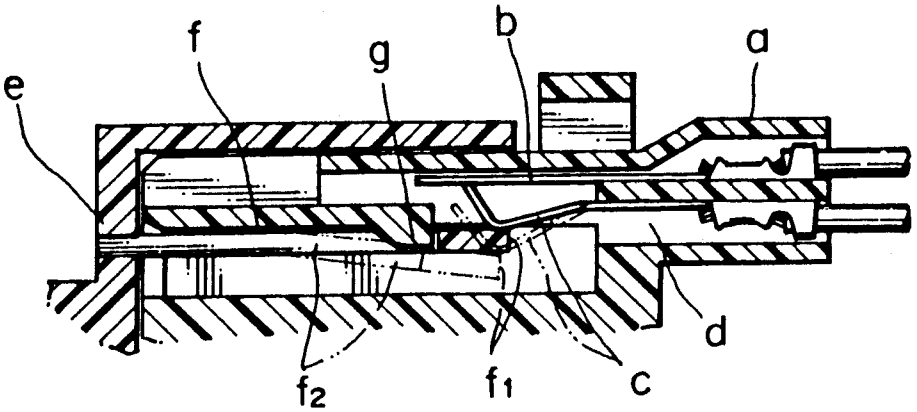
FIG. 7b PRIOR ART

When the male and female connector housings A, B are completely connected, as shown in FIG. 5*c*, the resilient lock arm 3 snaps back into its original shape causing the unlock press portion 3*c* to abut against the undersurface of the top plate portion 6*a* of the movable piece 6. As a result the contact portions 7*a* are shorted by the short-circuit conducting path 9. Now, the detection circuit is completed through the short-circuit conducting path 9, the connecting electric paths 7, and the female terminal lugs C in contact with the elastic contact ends 7*b*.

The construction and advantages of this invention may be summarized as follows.

The connector engagement detecting apparatus of this invention consists of a connector housing with a resilient lock arm and another mating connector housing with an engagement portion that cooperates with the resilient lock arm. The first connector housing is provided with an engagement detection movable piece, which has two connecting electric paths and is movable relative to the resilient lock arm. Contact ends of the two connecting electric paths are situated in slots formed between the displacement permitting space for the lock arm and the adjacent terminal accommodating chambers so that the contact ends are in sliding contact with the terminal lugs installed in the terminal accommodating chambers. When the male and female connector housings are completely connected, the short-circuit conducting path on the free end of the resilient lock arm is brought into contact with the two connecting electric paths. This construction permits the engagement detection movable piece and the short-circuit conducting path to be incorporated into the connector housings without complicating the construction of the connector housings. Moreover, a stable operation of the engagement detection circuit is ensured.

What is claimed is:

1. A connector engagement detecting apparatus comprising:

a first connector housing and a second connector housing, said first and second connector housing being adapted to be joined together;

a resilient lock arm provided to the first connector housing;

an engagement portion provided to the second connector housing to cooperate with said resilient lock arm;

a movable piece for detecting the correct engagement of the two mating connector housings, said movable piece being mounted on the first connector housing so that it can be moved relative to the resilient lock arm;

two connecting electric paths formed on said movable piece and having elastic contact ends;

slots formed between a displacement permitting space for the resilient lock arm and adjacent terminal accommodating chambers, said slots being used to accommodate the contact ends of the two connecting electric paths so that the contact ends are in sliding contact with terminal lugs contained in the terminal accommodating chambers; and a short-circuit conducting path provided to a free end of the resilient lock arm, said short-circuit conducting path being adapted to engage with the two connecting electric paths when the first and second connector housings are connected completely.

2. A connector engagement detecting apparatus as claimed in claim 1, wherein said engagement detection movable piece is formed into a gate-like contour and movably straddled on the resilient lock arm, said two connecting electric paths provided to the movable piece extend from a top plate portion down to leg portions of the movable piece, and said elastic contact ends of the connecting electric paths are projected at the lower ends of the leg portions of the movable piece.

3. A connector engagement detecting apparatus as claimed in claim 1, wherein said resilient lock arm is made of an elastic material and formed as a cantilever that has a sufficient recovering force.

* * * * *